US005804064A

United States Patent [19]

Desrochers

[11] Patent Number: 5,804,064

[45] Date of Patent: Sep. 8, 1998

[54] SWIMMING POOL SKIMMER HAVING A DEFLECTOR MEMBER

[76] Inventor: Jacques Desrochers, 574, Alexandre, Laval, Quebec, Canada, H7G 3M5

[21] Appl. No.: 915,768

[22] Filed: Aug. 21, 1997

[51] Int. Cl.[6] ..... B01D 35/05; E04H 11/16; E02B 15/04

[52] U.S. Cl. ..... 210/169; 210/242.1; 4/490

[58] Field of Search ..... 210/169, 242.1; 4/490

[56] References Cited

U.S. PATENT DOCUMENTS

| | | | |
|---|---|---|---|
| 3,152,076 | 10/1964 | Kreutzer | 210/169 |
| 4,379,749 | 4/1983 | Roth | 210/169 |
| 4,720,340 | 1/1988 | O'Brien | 210/169 |
| 4,734,189 | 3/1988 | Pages, Jr. | 210/169 |

*Primary Examiner*—Neil McCarthy

[57] ABSTRACT

A deflector for use in a pool having a skimmer inlet and a recirculating means to set up a peripheral flow of pool water, the deflector comprising an elongated member of a closed cell foam material, a sleeve sized to extend about at least a portion of the elongated member, the sleeve having a generally C shaped body portion and a deflector blade portion extending from an axial marginal edge of the C shaped body portion, a cord for securing the elongated member to the pool adjacent the skimmer outlet so that the elongated member extends outwardly into the pool, the cord maintaining the elongated member an the deflector blade in a position such that the deflector blade extends downwardly into the pool water with a distal end of the deflectlor extending forwardly in a direction of the peripheral flow of the pool water. The arrangement minimizes any currents and subsequent collection of debris rearwardly of the deflector.

13 Claims, 2 Drawing Sheets

14
30
26
28
28

14
12
16
18
20
28
22
28
40
S 10
20
12
14
S
40
28

SWIMMING POOL SKIMMER HAVING A DEFLECTOR MEMBER

BACKGROUND OF THE INVENTION

The present invention relates to a swimming pool cleaning device and more particularly, it relates to a deflector type device for removing floating and slightly submerged debris from a swimming pool which has a water circulation and filtration system with a skimmer inlet located in a pool wall proximate the water level.

The problem of maintaining a swimming pool relatively free of debris is a major task associated with swimming pools. To this end, the art teaches the use of many different types of cleaning devices including various automated vacuum systems.

Almost all swimming pool filtration systems operate by continuously circulating the pool water. Generally, the intake for the pool water will consist of an optional bottom inlet and normally always an upper inlet with the upper inlet generally being known as a skimmer inlet. The water from the pool passes through a filter and is returned by a circulating pump. The upper water inlet known as the skimmer is designed to remove surface debris. This is accomplished since the return ports tend to set up a relatively weak current about the periphery of the pool. However, the current is not sufficiently strong nor is the intake at the skimmer sufficiently powerful to remove a large quantity of the debris from the surface of the water.

Since it is well known that substantially all the dirt enters the pool from the surface of the water and remains thereon for a substantial period of time, if one were able to effectively remove the material from the water surface quickly enough, the amount of pool maintenance would be substantially minimized.

It is known in the art to use deflector members mounted on the side of the pool to attempt to deflect more surface material into the skimmer as it circulates about the pool. Thus, U.S. Pat. No. 4,720,340 discloses a vertically upright elongated skimmer blade which is mounted proximate the skimmer inlet. U.S. Pat. No. 4,734,189 also discloses a deflector apparatus which is designed to be angularly mounted as may be seen in the drawings thereof. A similar type of arrangement is shown in U.S. Pat. No. 3,152,076 and also in U.S. Pat. No. 4,379,749.

As will be seen from the above patents, deflector blades do increase the amount of debris which is collected by the skimmer. However, a common problem which occurs with deflector blades is the collection of debris to the rear of the deflector. In practice, various eddy currents are caused by the deflector and as a result, any debris which bypasses the deflector tends to collect rearwardly of the deflector until, after a period of time, it will sink to the bottom of the pool from where it must be removed. This problem somewhat negates the advantage of having a deflector blade mounted on the pool surface.

SUMMARY OF THE INVENTION

It is therefore an object of the present invention to provide a deflector for use with a pool skimmer inlet, and which deflector minimizes the eddy currents and debris rearwardly of the deflector member.

It is a further object of the present invention to provide a deflector for a swimming pool and which deflector member is effective, simple to manufacture, and easy to use.

According to one aspect of the present invention there is provided a pool having a skimmer inlet and a recirculating means to set up a peripheral flow of pool water, the improvement comprising a deflector mounted adjacent the skimmer inlet, the deflector comprising an elongated member having first and second ends, a substantially planar deflector blade extending outwardly from the elongated member along an axial length thereof, attachment means for securing the elongated member to the pool such that the first end lies adjacent the skimmer inlet and seats thereon, the elongated member extending outwardly into the pool, the attachment means maintaining the elongated member and the deflector blade in a position such that the deflector blade extends downwardly from the elongated member into the pool water, a distal end of the deflector blade extending forwardly in a direction of the peripheral flow of pool water, the deflector blade lying in a plane forming an angle of between 32 degrees and 42 degrees with a horizontal plane. According to a further aspect of the present there is provided a deflector kit for a pool, the deflector comprising an elongated member of a closed cell foam material, a sleeve sized to extend about at least a portion of the elongated member, the sleeve having a generally C shaped body portion and a deflector blade portion, the deflector blade portion extending from an axial marginal edge of the C shaped body portion, an aperture extending through the C shaped body portion and the elongated member, the aperture extending transverse to an axial length of the elongated member, a tubular sized to fit within the aperture, and an elasticized cord.

As will be appreciated, the deflector can take several different forms. In one preferred embodiment of the invention, the deflector comprises a central core having an outer sleeve formed of a sheet material. However, as will be understood by those skilled in the art, a one piece unit formed of a single material could be utilized.

In the preferred embodiment, the central core will comprise a elongated member formed of a material which is floatable in the water with a preferred material being a closed cell foam material. Such materials are well known in the art and readily available in various sizes.

The sleeve or outer member surrounding at least a portion of the inner cylindrical portion may be formed of any suitable material with a preferred material being a plastic sheet material such as one of the polyvinyl materials. The material should be sufficiently rigid for the purposes of the invention and may also serve as a solar protector for the inner core and as a structural reinforcement therefore.

The deflector blade of the deflector preferably comprises a planar section which is tangential to the inner core. The deflector blade extends along most of the axial length of the member and outwardly from the central core such that it is angled downwardly and forwardly with respect to a current flow in the pool while also lying substantially in a single plane.

The overall dimensions of the deflector may vary depending on the pool dimensions and the desired cleaning effect. Preferably, the deflector has a length of between 30 cm and 150 cm.

The density of the member is preferably such that the deflector is immersed only to a depth of approximately between 1 cm and 4 cm.

The deflector is attached to the side of the pool adjacent the skimmer inlet and in a preferred embodiment, a flexible elastic member is utilized for so doing. The elastic member will permit the movement of the deflector when subjected to a sufficient force (such as by a swimmer) and this flexibility serves as a safety feature.

Preferably, a two point attachment is utilized with the elastic member passing through the deflector body and being attached to the side of the pool at the two points. In order to accomplish the attachment, there may be provided a tube which extends through the outer sleeve and also through the inner core. This arrangement serves both the function of attaching the deflector to the side of the pool and also to ensure the proper positioning of the outer sleeve with respect to the inner core.

The means of attaching to the sides of the pool can be any suitable and to this end, various types of hook members, screws, and the like may be utilized.

To provide for an interface between the deflector and the side of the pool, the end of the deflector may be configured to have a recess which is designed to abut the side of the skimmer in an arrangement to maintain the positioning of the deflector.

BRIEF DESCRIPTION OF THE DRAWINGS

Having thus generally described the invention, reference will be made to the accompanying drawing illustrating an embodiment thereof, in which.

DESCRIPTION OF THE PREFERRED EMBODIMENT

Figure 1:
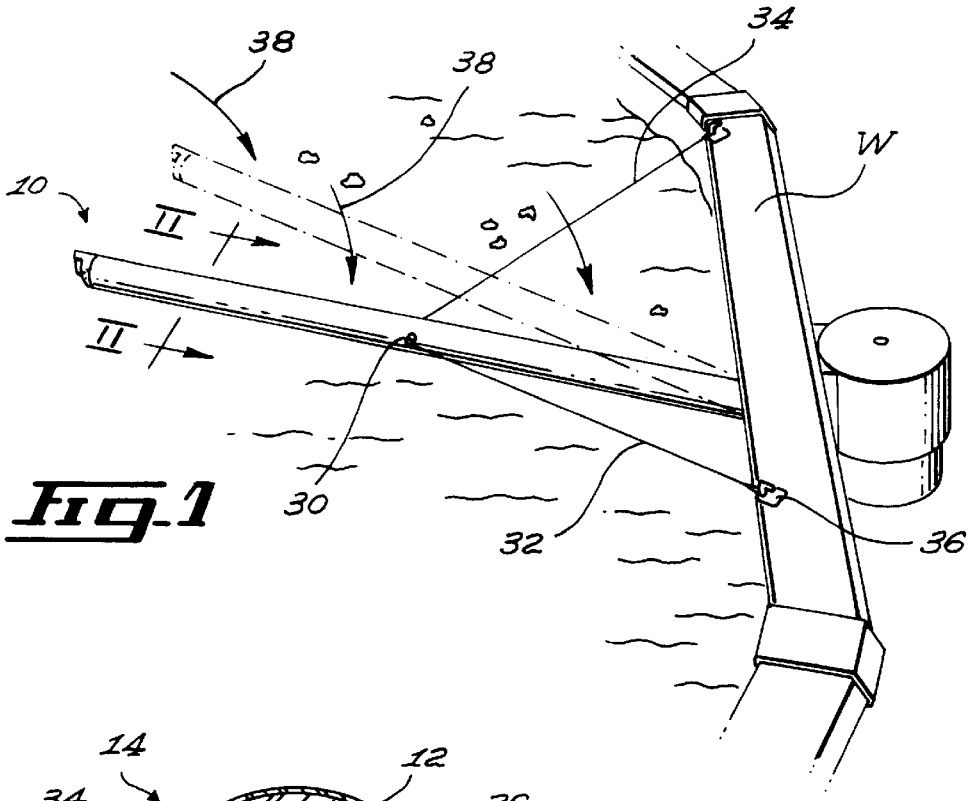
FIG. 1 is a perspective view illustrating the deflector of the present invention as used in an above ground swimming pool.

Referring to the drawings in greater detail and by reference characters thereto, the deflector of the present invention is generally designated by reference numeral 10 and is comprised of an inner core 12 and an outer sleeve 14. Inner core 12 is formed of a closed cell foam material and has an overall cylindrical configuration. Both ends are substantially identical and thus only one will be described herein.

Figure 3:
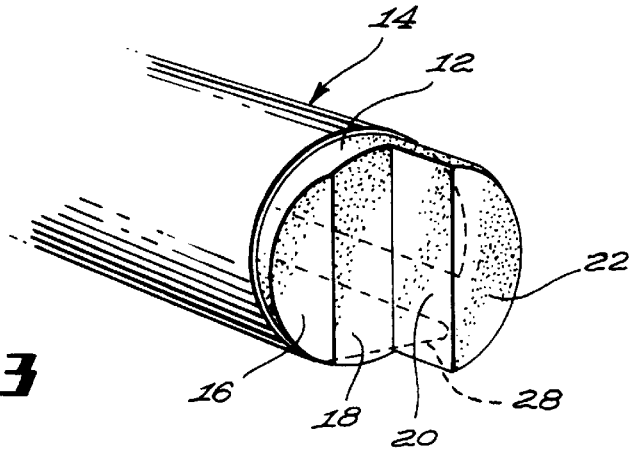
FIG. 3 is a perspective view of one end of the deflector.
Figure 5:
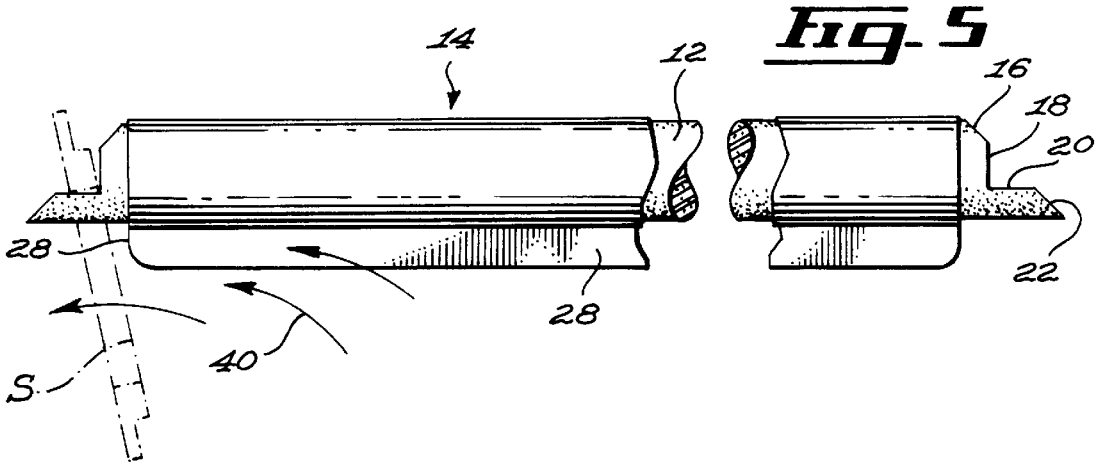
FIG. 5 is a side elevational view illustrating the operation of the deflector.

As may be best seen in FIGS. 3 and 5, at the end of inner core 12, there is provided a recess defined by a first bevelled surface 16 which terminates in a perpendicular surface 18; in turn, an axially extending surface 20 joins perpendicular surface 18 and a second bevelled surface 22. The reason for this arrangement will be described hereinbelow.

Figure 4:
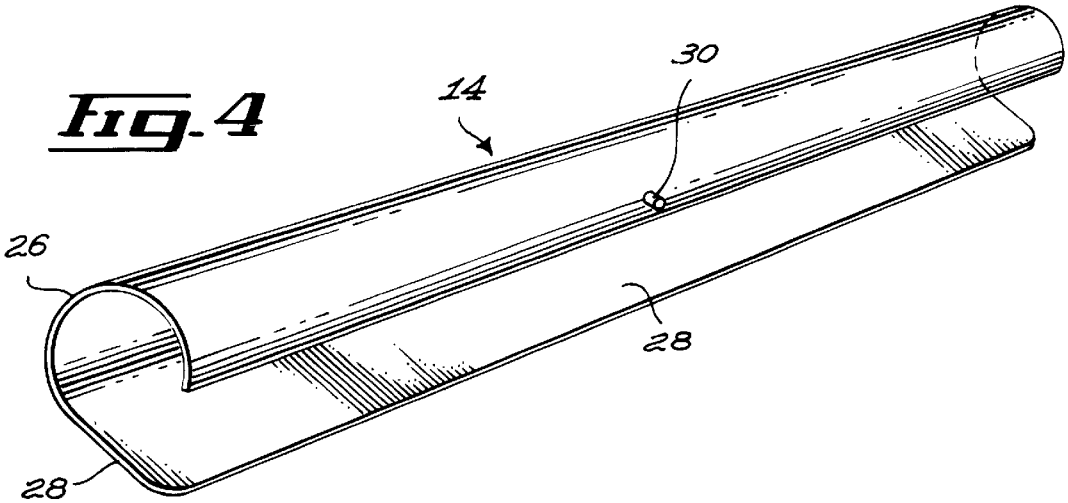
FIG. 4 is a perspective view of the outer sleeve of the deflector.

Sleeve 14 is illustrated in FIG. 4 and as may be seen therein, it has a C shaped portion 26 adapted to partially encircle inner core 12. In the illustrated embodiment, and as may be clearly seen in FIG. 2, C shaped portion 26 extends through an angle greater than 180 N so as to retain inner core 12 therein. At one end of C shaped portion 26, there is provided a downwardly extending tangential deflector blade 28 for reasons which will become apparent hereinbelow.

As may be seen in the drawings, sleeve 14 has an overall length slightly less than the length of inner core 12 such that the bevelled surfaces 16 and 22 are exposed.

Figure 2:
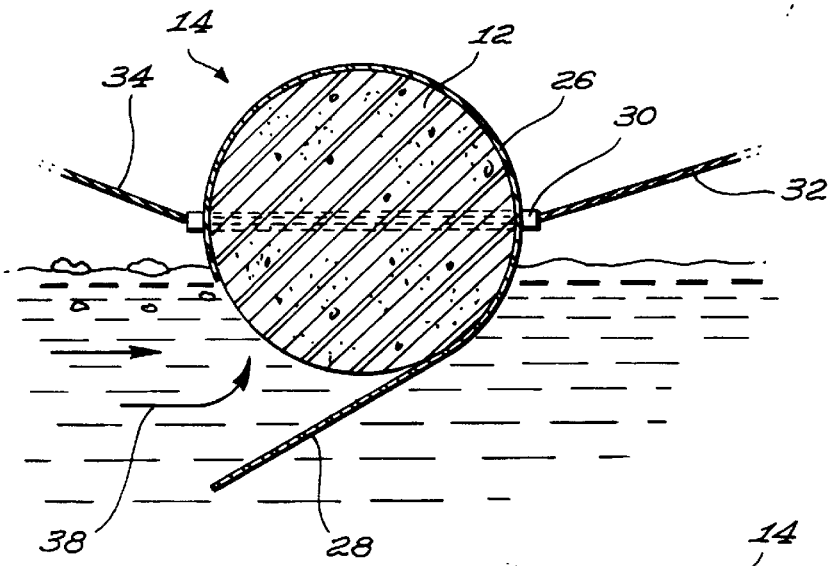
FIG. 2 is a cross sectional view taken along the lines 2—2 of FIG. 1.

For anchoring deflector 10, and as may be seen in FIGS. 1 and 2, there is provided a tubular member 30 which extends substantially diametrically through inner core 12 and sleeve 14. Member 30 is designed to receive a cord 32 which is preferably of a somewhat elastic material. Cord 32 is anchored at either end by means of hooks 34 and 36 mounted on swimming pool wall W.

Figure 6:
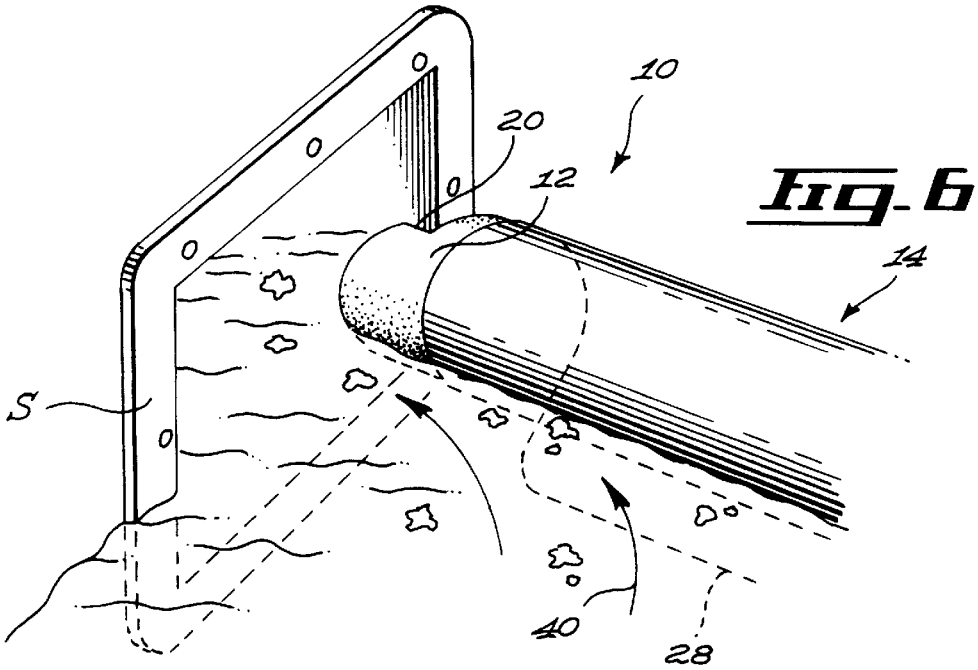
FIG. 6 is a perspective view illustrating the end of the deflector mounted at a skimmer inlet.

In operation, deflector 10 is placed, as may be seen in FIGS. 5 and 6, such that perpendicular surface 18 and axial surface 20 abut the walls of a skimmer inlet S. Cord 36 is threaded through sleeve 30 and secured at either end to hooks 34 and 36.

The pool filtration system and associated pump are designed to cause the water to flow as indicated by flow arrows 38. Deflector 10 extends outwardly into the pool to intercept the flow of any debris and, as shown in FIG. 6, the debris will flow to skimmer S as indicated by arrows 40.

The arrangement of downwardly extending tangential deflector blade 28 is such as to permit the formation of a minimum of turbulence rearwardly thereof and thus, any particles or debris which are not caught by deflector 10 will continue circulating for entrapment on the next pass.

As illustrated in FIG. 1, the mounting by means of elastic cord 32 permits deflector 10 to move to the position shown in dotted lines when a sufficiently large physical force is applied thereto such as by a swimmer.

It will be understood that the above described embodiments is for purposes of illustration only and that changes and modifications may be made thereto without departing from the spirit and scope of the invention.

What is claimed is:

1. In a pool having a skimmer inlet and a recirculating means to set up a peripheral flow of pool water, said improvement comprising a deflector mounted adjacent said skimmer inlet, said deflector comprising:

a) an elongated member having first and second ends;

b) a substantially planar deflector blade extending outwardly from said elongated member along an axial length thereof;

c) attachment means for securing said elongated member to said pool such that said first end lies adjacent said skimmer inlet and seats thereon, said elongated member extending outwardly into the pool;

d) said attachment means maintaining said elongated member and said deflector blade in a position such that said deflector blade extends downwardly from said elongated member into said pool water, a distal end of said deflector blade extending forwardly in a direction of said peripheral flow of pool water, said deflector blade lying in a plane forming an angle of between 32 degrees and 42 degrees with a horizontal plane.

2. The deflector of claim 1 wherein said deflector blade lies in a plane forming an angle of between 35 degrees and 39 degrees with said horizontal plane.

3. The deflector of claim 1 wherein said attachment means comprises a cord, said cord extending transversely through said elongated member, said cord being secured at either end thereof to said pool.

4. The deflector of claim 3 further including an aperture formed in said elongated member, a tubular member sized to fit within said aperture, said cord passing through said tubular member.

5. The deflector of claim 1 wherein said elongated member is formed of a closed cell foam material.

6. The deflector of claim 5 wherein said deflector comprises an inner core and a sleeve, said sleeve extending about at least a portion of said elongated member, said sleeve having a C-shaped body portion, said deflector blade extending from an axial marginal edge of said C shaped body portion.

7. The deflector of claim 1 wherein said elongated member comprises an elongated cylindrically shaped member formed of a closed cell foam material, said deflector blade extending substantially tangential to said elongated member.

8. The deflector of claim 7 further including a sleeve, said sleeve extending about a portion of said elongated member, said sleeve having a C shaped body portion, said deflector blade extending outwardly from an axially extending marginal edge of said C shaped boy portion.

9. The deflector of claim 4 wherein said cord comprises an elasticized cord to thereby permit movement of said member.

10. The deflector of claim 5 wherein said first end of said elongated member includes a recess formed therein, said recess being configured to abut a wall of said skimmer inlet.

11. A deflector kit for a pool, said deflector comprising:

a) an elongated member of a closed cell foam material, b) a sleeve sized to extend about at least a portion of said elongated member, said sleeve having a generally C shaped body portion and a deflector blade portion, said deflector blade portion extending from an axial marginal edge of said C shaped body portion, c) an aperture extending through said C shaped body portion and said elongated member, said aperture extending transverse to an axial length of said elongated member, d) a tubular member sized to fit within said aperture, and e) an elasticized cord.

12. The deflector kit of claim 1 further including hook means, said hook means having means associated therewith for securement to a pool wall.

13. The deflector kit of claim 11 wherein said sleeve comprises a formed sheet of a plastic material.

* * * * *